US012435712B2

(12) United States Patent
Giles

(10) Patent No.: US 12,435,712 B2
(45) Date of Patent: Oct. 7, 2025

(54) HIGH PRESSURE AIR OPERATED DOUBLE DIAPHRAGM PUMP

(71) Applicant: David Adrian Giles, Slinfold (GB)

(72) Inventor: David Adrian Giles, Slinfold (GB)

(73) Assignee: Unibloc Hygienic Technologies UK, Ltd., Bolney (GB)

( * ) Notice: Subject to any disclaimer, the term of this patent is extended or adjusted under 35 U.S.C. 154(b) by 46 days.

(21) Appl. No.: 18/409,160

(22) Filed: Jan. 10, 2024

(65) Prior Publication Data

US 2024/0280095 A1 Aug. 22, 2024

Related U.S. Application Data

(60) Provisional application No. 63/446,155, filed on Feb. 16, 2023.

(51) Int. Cl.
*F04B 43/073* (2006.01)

(52) U.S. Cl.
CPC ..... *F04B 43/0736* (2013.01)

(58) Field of Classification Search
CPC ..... F04B 43/0736
See application file for complete search history.

(56) References Cited

U.S. PATENT DOCUMENTS 4,123,204 A * 10/1978 Scholle ..... F04B 9/135 417/393
4,242,941 A * 1/1981 Wilden ..... F01L 25/06 91/329
4,247,264 A * 1/1981 Wilden ..... F01L 25/06 417/393
6,382,934 B2 * 5/2002 Budde ..... F01L 25/066 91/286
8,469,681 B2 * 6/2013 Wheal ..... F04B 43/0736 417/538
9,004,881 B2 * 4/2015 Simmons ..... F04B 53/22 417/427
2007/0065305 A1 * 3/2007 Budde ..... F04B 53/1002 417/395

* cited by examiner

*Primary Examiner* — Jesse S Bogue
(74) *Attorney, Agent, or Firm* — Miller & Martin PLLC

(57) ABSTRACT

A double diaphragm pump has opposing diaphragms which are alternatingly acted upon at an activation side by an activating fluid, like air. The opposite side of the diaphragms is a pumping side. The surface area of the activation side is greater than the pumping side so as to provide a higher pressure of the pumped fluid than the activating fluid.

4 Claims, 3 Drawing Sheets

HIGH PRESSURE AIR OPERATED DOUBLE DIAPHRAGM PUMP

CLAIM OF PRIORITY

This application claims the benefit of U.S. Provisional Patent Application No. 63/446,155 filed Feb. 16, 2023, which is incorporated herein by reference in its entirety.

FIELD OF THE INVENTION

The present invention relates to air operated double diaphragm pumps, and more particularly to air operated double diaphragm pumps which have higher output fluid pressure pumped by the pump than input air pressure driving the pump.

BACKGROUND OF THE INVENTION

Air operated double diaphragm pumps typically operate on shop air pressure which is usually up to about 125 psi. Since a diaphragm in these pumps pushes fluid, normally the pressure on one side of the air input side of the diaphragm is the maximum fluid output pressure on the pump fluid side. In order to increase pressure of pump fluids some companies have added external pressure boosters which take input shop air and increase the pressure provided to the air input side of the pump. These pressure boosters are relatively complex and add a potential source of failure.

At least one company, Wildon, provides a separate external piston other than the diaphragm which receives air input so that for each outlet stroke of the pump, a diaphragm and a piston are acted on by air input to increase the surface area acted upon by the air relative to the surface area acting upon the liquid. In fact, for some of these designs, a three to one ratio is achieved. For these constructions, the surface area of the diaphragms acting on the fluid directly corresponds to the surface air acted on by a first air diaphragm that is the normal air diaphragm that pumps most air operated double diaphragm pumps which is a 1:1 ratio. A separate power amplifier piston also receives air input in a similar manner as on an air side of the diaphragm to then simultaneously pressure to the fluid side of the diaphragm so to achieve this increase in pressure. The power amplification piston has twice the surface area of the fluid side of the diaphragm. Together, a 3:1 surface area ratio is achieved. This technology is discussed in U.S. Pat. No. 5,927,954. This technology is also believed to be effective, but complicated, solution to increasing the output pressure of a double diaphragm pump above the input pressure of air operating the pump.

There is still believed to be a need to provide an improved air operated double diaphragm pump to the marketplace which increases output pressure on the fluid side of the pump above the pressure of input air in a relatively simple and robust manner.

SUMMARY OF THE INVENTION

Accordingly, it is an object of many embodiments of the present invention to provide an improved air operated double diaphragm pump.

It is another object of many embodiments of the present invention to provide an improved air operated double diaphragm pump utilizing pumping diaphragms having a greater effective surface area on the air side than on the fluid side acting on the fluid thereby resulting in a multiplication of the input air pressure by the relative difference in surface area to the output fluid as outlet fluid pressure.

Accordingly, in accordance with at least some presently preferred embodiments of the present invention, a double diaphragm pump is provided having first and second air chambers and corresponding first and second fluid chambers. The fluid chambers alternatingly receive fluid from a fluid inlet and alternatingly discharge to a fluid outlet depending on the position of the air chambers. The air and fluid chambers are preferably symmetrically disposed relative to a centerline of the pump.

The applicant provides a thrust tube which connects to each of the diaphragms. The thrust tube of this present application is proportionately greater than prior art designs of the applicant relative to the diameter of a tie rod that the thrust tube reciprocates about. Accordingly, this results in a differential of the effective surface area between the air side of the diaphragm being approximately 1.3 times greater than the surface air of the fluid side (i.e., the thrust tube obscures a significant portion of the diaphragm on the fluid side). Therefore, the pressure acting upon the fluid occurs at a factor of 1.3 times the air pressure in the corresponding air cavity. This increase in surface area occurs at the diaphragm and within the housing(s) of the pump.

By providing a larger diameter thrust tube than prior art designs relative to the diameter of the tie rod, the difference in surface area (and corresponding pressures) can be affected. There are likely other ways of increasing this relative surface area difference internal to pump housings the diaphragms such as, but not limited to, providing non-symmetrical diaphragms which have a surface area on the air side greater than on the fluid side, etc.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
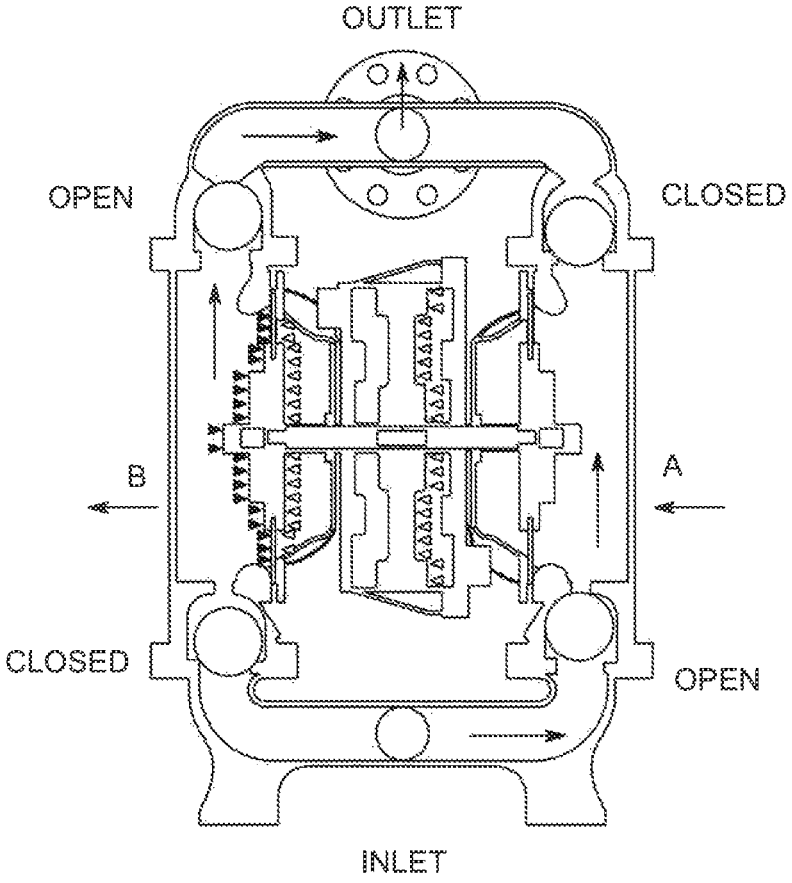
FIG. 1 is a schematic view of a prior art high pressure air operated double diaphragm pump.

FIG. 1 is a prior art double diaphragm pump as shown and described in U.S. Pat. No. 5,927,954 which is incorporated herein by reference in its entirety. The power amplifier piston of that design provides an external mechanism to receive an air input pressure in addition to air pressure against the diaphragm to act on fluid in the fluid chamber as described above.

Traditional pneumatic double diaphragm pumps 1 are shown in FIG. 1. The applicant's prior art pneumatic double diaphragm pump 1 of FIG. 2 utilizes an air valve 2 which has an internal spool allowing compressed air to be alternatively directed between air chambers 3 and 4 which drive the thrust tube 5 back and forth thereby directing diaphragms 8,9 to move in the direction of the thrust tube 5 along axis 10 to then direct fluid from inlet 11 through fluid chambers 6,7 which selectively increase and decrease in volume to direct fluid out outlet 12 as is well known in the art. Tie rod 13 provides a surface for thrust tube 5 on thrust tube bearings 14 to reciprocate along axis 10.

Figure 2:
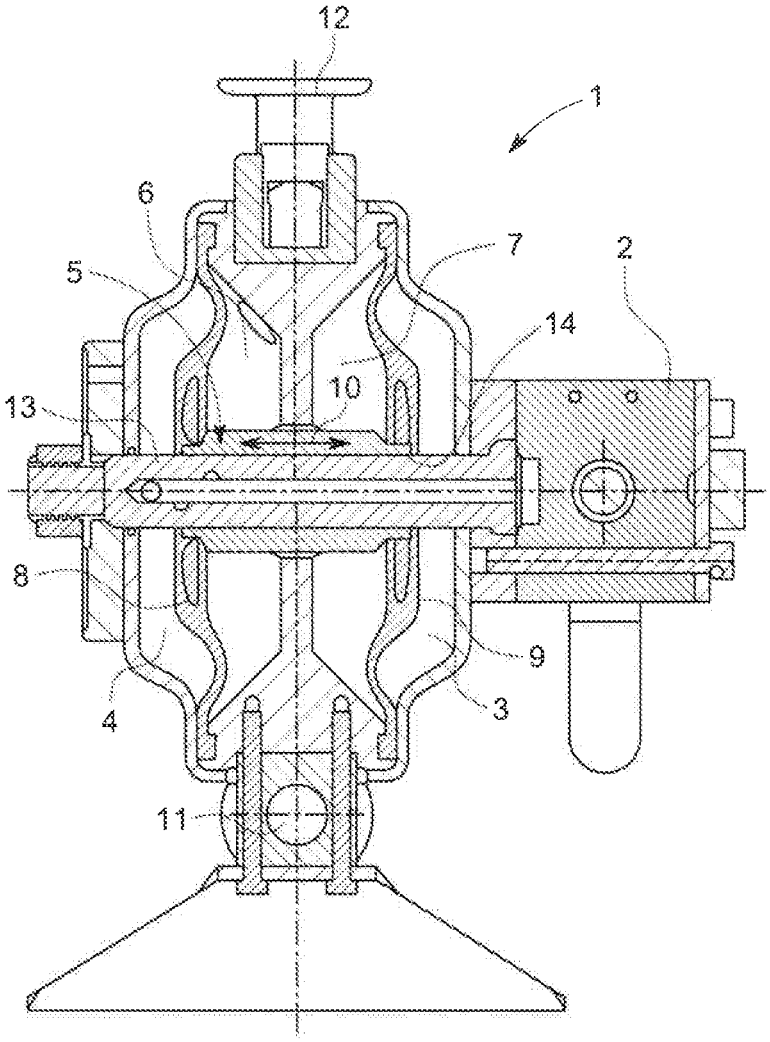
FIG. 2 is a schematic representation of applicant's prior art double diaphragm pump.

As one can see from viewing FIG. 2, the surface area on the air chamber sides 3,4 of the diaphragms 8,9 is approximately the same as the surface area of the diaphragms 8,9 facing the fluid chambers 6,7. Thus input air pressure directed into one of the air chambers 3,4 corresponds approximately to the output fluid pressure from outlet 12 as directed from the fluid chambers 6,7 as would be understood by those of ordinary skill in the art.

Figure 3:
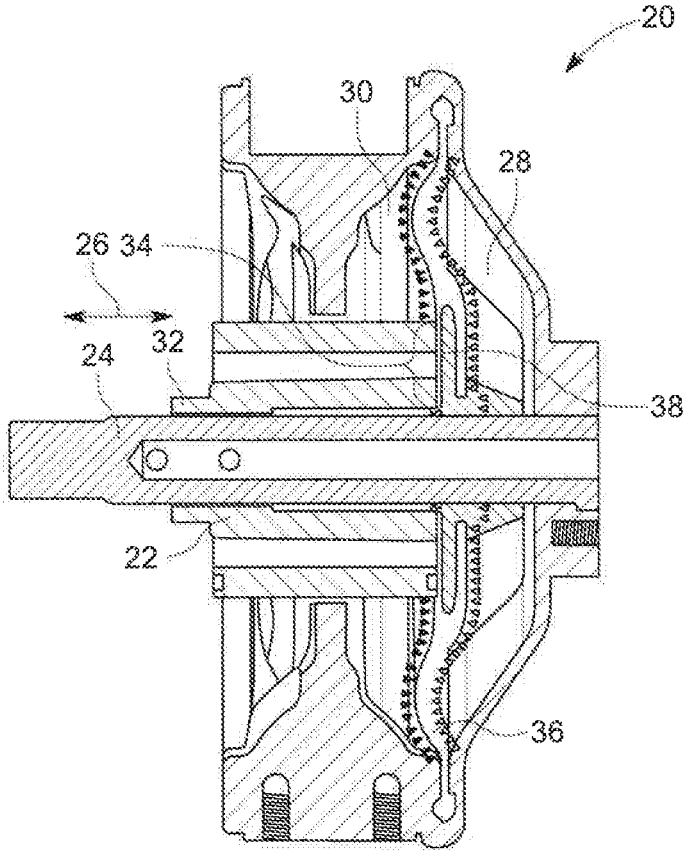
FIG. 3 is a partial schematic view of the applicant's air operated double diaphragm pump of a presently preferred embodiment of the present invention.

FIG. 3 shows a portion of the pump 20 which has essentially the same components as pump 1 of FIG. 2 except that a difference for this embodiment is the relative diameter of the thrust tube 22 relative to the tie rod 24. The thrust tube 22 reciprocates along axis 26 about the tie rod 26 preferably along thrust tube bearings 32.

The relative larger diameter of the thrust tube 22 relative to the tie rod 24 affects a significant portion of the surface area of the diaphragm 36 which is obscured by the thrust tube 22 and is shown as portion 34. Thus, when air is directed into the first air chamber 28 and acts on the diaphragm 36, the ratio of the effective surface area of the diaphragm 36 on the side facing the air chamber 28 is roughly 1.3 times as great as the surface area of the diaphragm 36 on the side acting on the fluid chamber 30. Because the air pressure is acting on a surface area approximately 1.3 times greater than the surface area acting on the fluid, a pressure increase of 1.3 acts upon the fluid as compared to the input pressure to the air chamber 28. 7.2 barg pressure of air on the air side results in 9.4 barg pressure on the fluid side (in the fluid chamber 30) as would be directed out a corresponding outlet to outlet 12 shown in FIG. 2.

In the illustrated embodiment, the diameter of the thrust tube 22 is approximately three times the diameter of the tie rod 24 with the diameter of the diaphragm being approximately five times the diameter of the tie rod. It is understood that other relative differences could be achieved in other embodiments.

While increasing the relative diameter of the thrust tube 22 to the rod 24 is certainly one way to reduce the effective surface area of the diaphragm 36 on the fluid chamber 30 side of diaphragm relative to the air pressure acting on the air chamber 28 side of diaphragm 36, other techniques can be employed to provide a larger relative surface area on the side of the air chamber 28 of diaphragm 36 relative to the side of the fluid chamber 30 of the diaphragm 36 for other embodiments. Nonsymmetrical diaphragms 36 may be employed and/or other techniques may be utilized to achieve this surface area differential which can directly relate to a pressure increase to the side of the fluid chamber 30 and thus a step up in pressure to provide a high pressure pump 20 as compared to the prior art pump 1 alternative.

Thrust tube face 38 along diaphragm portion 34 restricts movement of the diaphragm 36 in the fluid chamber 30 when acted upon by air pressure in the air chamber 28. This reduces the effective surface area on the fluid chamber 30 side of diaphragm 36 relative to the air chamber 28 side. Other techniques to change the surface ratios on sides of diaphragm 36 may be employed with other embodiments.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a double diaphragm pump having first and second diaphragms each having a fluid pumping side facing fluid chambers and an activation side whereby an air actuating fluid is selectively and oppositely directed to the activation sides of the first and second diaphragms to pump fluids from the fluid chambers, said improvement comprising:

a surface area of the activation side of each of the first and second diaphragms being at least 1.3 times greater than a surface area of the respective pumping side of the same diaphragm, independently of transitory contact with other pump components, thereby increasing a pumping pressure of fluid in the chambers to exceed a pressure of the air actuating fluid, an air valve directing fluid alternatingly between the activation sides of the first and second diaphragms, a thrust tube connecting the first and second diaphragms together, and the fluid chambers are defined between the first and second diaphragms and housings, and the thrust tube has a diameter of at least twice a diameter of a tie rod connecting the housings together.

2. The double diaphragm pump of claim 1 wherein the thrust tube reciprocates along an axis parallel to the tie rod about the tie rod.

3. The double diaphragm pump of claim 1 wherein the thrust tube has a diameter of at least about three times the diameter of the tie rod.

4. The double diaphragm pump of claim 3 wherein the first and second diaphragm each have a diameter of about five times the diameter of the tie rod.

* * * * *